US006421074B2

(12) United States Patent
Fujishiro

(10) Patent No.: US 6,421,074 B2
(45) Date of Patent: Jul. 16, 2002

(54) THERMAL PRINTER AND THERMAL RECORDING METHOD

(75) Inventor: Takeshi Fujishiro, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/796,524

(22) Filed: Mar. 2, 2001

(30) Foreign Application Priority Data

Mar. 2, 2000 (JP) ..... 2000-056645

(51) Int. Cl.[7] ..... B41J 2/32; B41M 5/26; B41M 5/34

(52) U.S. Cl. ..... 347/175; 347/212

(58) Field of Search ..... 347/172, 175, 347/212

(56) References Cited

U.S. PATENT DOCUMENTS 6,084,624 A 7/2000 Yamakawa ..... 347/175

*Primary Examiner*—Huan Tran
(74) *Attorney, Agent, or Firm*—Sughrue Mion, PLLC

(57) ABSTRACT

In magenta fixation, when a rear end of a recording area reaches a first fixation area, a small shutter plate moves at a speed equal to conveyance of a recording material. When a shutter plate reaches a shutting position to cover a low-intensity area, a controller stops conveyance of the recording material. Then, Electromagnetic rays are applied to a rear portion of the stationary recording sheet, until an amount of applied rays of the rear end is equal to that of a front portion. Since the rear end of the recording area is faced to a high-intensity area, fixation time can be shortened without enlarging printer size.

14 Claims, 6 Drawing Sheets

THERMAL PRINTER AND THERMAL RECORDING METHOD

BACKGROUND OF THE INVENTION

1. Field of the Invention

The present invention relates to a thermal printer and a thermal recording method. More particularly, the present invention relates to a thermal printer and a thermal printing method capable of shortening fixation time without enlarging the device size.

2. Background Arts

In a color thermal printer, a color thermosensitive recording sheet or material is used to print a full-color image thereon according to the method of the frame-sequential printing. As shown in FIG. 5, The color thermosensitive recording sheet 5 (hereinafter referred to as recording sheet) includes a support 6 and a cyan thermosensitive coloring layer 7 (cyan coloring layer), a magenta thermosensitive coloring layer 8 (magenta coloring layer) and a yellow thermosensitive coloring layer 9 (yellow coloring layer), which are formed on the support 6 in this order listed. The yellow coloring layer 7 has the highest thermal sensitivity, and the cyan coloring layer 9 has the lowest one. The color thermal printer has a thermal head to press the recording sheet 5 in print operation. The thermal head is heated according to the print data, so that respective color image is recorded to each coloring layer. At first, a yellow image is recorded onto the yellow coloring layer 7 line by line, and the yellow coloring layer 7 is fixed by applying near-ultraviolet rays. Then, a magenta image is recorded in the magenta coloring layer 8, which is fixed by applying ultraviolet rays afterward. Lastly, a cyan image is recorded to the cyan coloring layer 9 so that a full-color image is recorded to the recording sheet 5.

A fixer is used to carry out fixation of the yellow and magenta coloring layers. Two kinds of fixers are incorporated in the printer, a yellow fixer lamp and a magenta fixer lamp. As shown in FIG. 6A, each fixer 2 includes two fixer lamps 3 and a reflector 4. The fixer lamp 3 emanates ultraviolet rays of peculiar wavelength to fix corresponding coloring layer. The cyan coloring layer 9 is not fixative, because its thermal sensitivity is so low that the cyan coloring layer 9 is not colored in handling;the printed sheet 5. The reflector 4 covers the fixer lamps 3, and has an opening in its lower side, so that ultraviolet rays emanated upward is reflected toward the recording sheet 5.

As a fixation method for fixing the recording sheet by the fixer 2, a passage fixation method and a stop fixation method are used. In the passage fixation method, each coloring layer is fixed while the recording sheet 5 is fed at a certain speed below the fixer 2. FIG. 6C shows a graph of applied amount of ultraviolet rays in the passage fixation method. While the recording sheet 5 is fed from A position, corresponded to the rear end in the fixation area, to B position, corresponded to the front end in the fixation area, the coloring layer is fixed by ultraviolet rays. When the color recording sheet 5 moves A position to B position, the amount of applied rays comes up to about 280 mW. The amount is enough to fix the coloring layer.

In case of a continuous recording sheet, a shutter plate is used for covering next-recording area. When the border between the recording area (present recording area) and the next-recording area reaches the A position, the shutter plate begins moving, and follows the border at the speed equal to that at which the recording sheet 5 is conveyed. Therefore, the next-recording area is kept from being fixed by the ultraviolet rays. This fixation method has an advantage that ultraviolet rays are applied to the whole recording area uniformly, so this fixation method is applied for fixing yellow coloring layer, in which over or under fixation is mattered.

In the stop fixation method, the coloring layer is fixed by applying ultraviolet rays onto the stationary recording sheet 5 for a certain time. In practical, the length of the recording area in the advancing direction is longer than that in the fixation area, so the passage fixation method is used in the beginning of print operation. When the rear end of the recording area reaches the rear end of the fixation area, the recording sheet 5 stops. Then, ultraviolet rays are applied to the stationary recording sheet 5 until applied amount of the rear end of the recording area becomes the same as that in the front portion of the recording area. This fixation method is applied for fixing the magenta coloring layer 8, because the cyan coloring layer 9, to which cyan image is recorded afterwards, is not influenced even if excessive amount of ultraviolet rays are applied.

The stop fixation method has a disadvantage that fixation time is longer than that of the passage fixation method. This is because intensity of ultraviolet rays is different according to the position in the fixation area. As shown in FIG. 6B, there is a low-intensity area in which intensity of ultraviolet rays is lower than that in the center. To fix whole recording area completely by using the stop fixation method, it is necessary to fix the low-intensity area completely. For instance, 2.8 seconds fixation is enough to have ultraviolet rays of 280 mW, the same amount in the passage fixation method, in the C point near the center of the fixation area. On the other hand, 4.8 seconds of fixation is required to have the same amount at a position near the A position.

To solve the above problem, passage fixation method may be used for fixing the magenta coloring layer 8. In that case, if the recording sheet 5 is long, two shutter plates for yellow and magenta fixation are required. The space for an additional shutter plate increases the printer size. Moreover, printing time will be longer because the length of the passage is increased by the retracting space of the additional shutter space.

SUMMARY OF THE INVENTION

An object of the invention is to provide a thermal printer and a thermal recording method to reduce fixation time without enlarging the printer size.

To achieve the above-identified object, the thermal printer of the present invention includes a shutter plate for covering the low-intensity area in the fixation area, for changing an area to apply the electromagnetic rays into a second fixation area from a first fixation area; a shutter moving mechanism for moving the shutter plate between a first position where the electromagnetic rays are applied to the first fixation area, and a second position where the electromagnetic rays are applied to the second fixation area; and a controller for moving said shutter plate from the first position to the second position at a speed equal to conveyance of the recording material when a rear end of the recording area reaches a rear end of the first fixation area, stopping conveyance of the recording material when the rear end of the recording area reaches a rear end of the second fixation area, and stopping application of the electromagnetic rays onto a rear portion of the recording area when an amount of applied rays in the rear end of the recording area becomes is equal to that of a front portion of the recording area.

In the embodiment, the thermal printer includes a pair of feeding rollers to feed the recording sheet back and forth, and the feeding rollers area located in positions upstream of the thermal head for recording an image. The thermal printer also includes a fixer that is located in a position downstream of the thermal head. The fixer includes a fixation lamp for emanating said electromagnetic rays and a reflector for reflecting said electromagnetic rays toward said recording material.

The recording material has a yellow, magenta and cyan thermosensitive coloring layers for recording full-color image. Yellow fixation is carried out without stopping conveyance of the recording material. In magenta fixation, when the rear end of the recording area reaches to the second fixation area, the controller stops feeding the recording material, and then electromagnetic rays are applied to the stationary recording material, as described above.

In the another embodiment, the reflector includes a reflector body and a side wall that is rotatably attached to a rear side of the reflector body. The side wall is substituted for the shutter plate.

According to the present invention, since the rear end of the recording area is positioned in a high-intensity area, it is possible to shorten fixation time.

BRIEF DESCRIPTION OF THE DRAWINGS

The above and other objects and advantages of the present invention will become apparent from the following detailed description of the preferred embodiments when read in association with the accompanying drawings, which are given by way of illustration only and thus are not limiting the present invention. In the drawings, like reference numerals designate like or corresponding parts throughout the several views, and wherein.

DETAILED DESCRIPTION OF THE INVENTION

Figure 1:
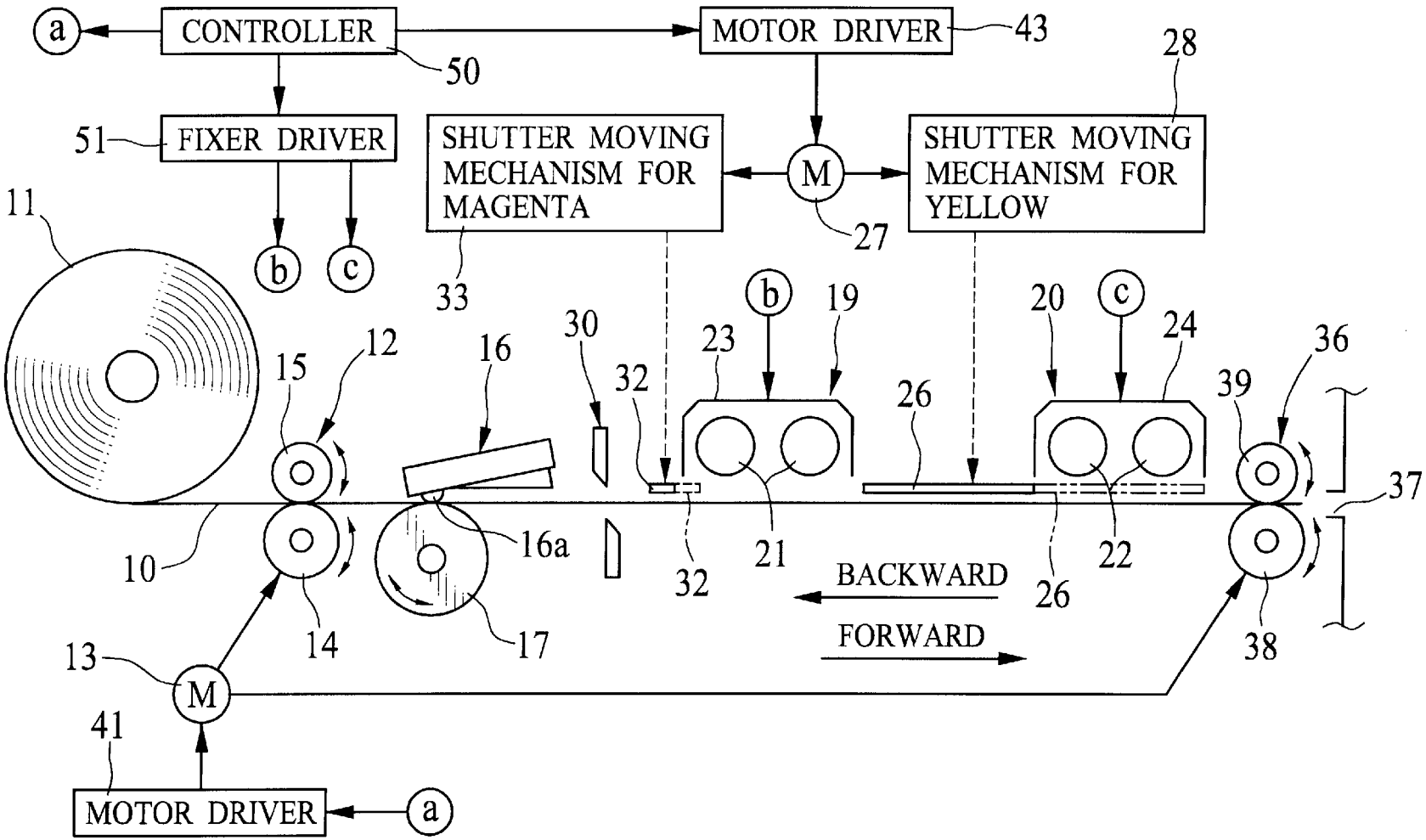
FIG. 1 is a schematic view showing a color thermal printer of the present invention.

As shown in FIG. 1, a continuous recording sheet 10 is used as a recording material. The recording sheet 10 has a plurality of recording areas, each of which is defined by a predetermined size. The recording sheet 10 is wound to be a recording sheet roll 11, which is set in the color thermal printer.

A feeding roller set 12, which is disposed nearby the recording sheet roll 11, nips the recording sheet 10 drawn from the recording sheet, roll 11 to feed it. The feeding roller set 12 includes a capstan roller 14 and a pinch roller 15. The capstan roller 14 is rotated by the feeding motor 13, which is connected to a controller 50 through a motor driver 41. When the controller 50 drives the feeding motor 13, the feeding roller set 12 are rotated to feed the recording sheet 10 forward (advancing direction) and backward (recording direction). The feeding roller set 12, the feeding motor 13 and the motor driver 41 comprise feeding means.

The recording sheet roll 11 is usually biased in the direction to rewind the recording sheet 10. Thus, in feeding the recording sheet 10 backward, the recording sheet 10 is rewound to the recording sheet roll 11 without being folded.

Figure 5:
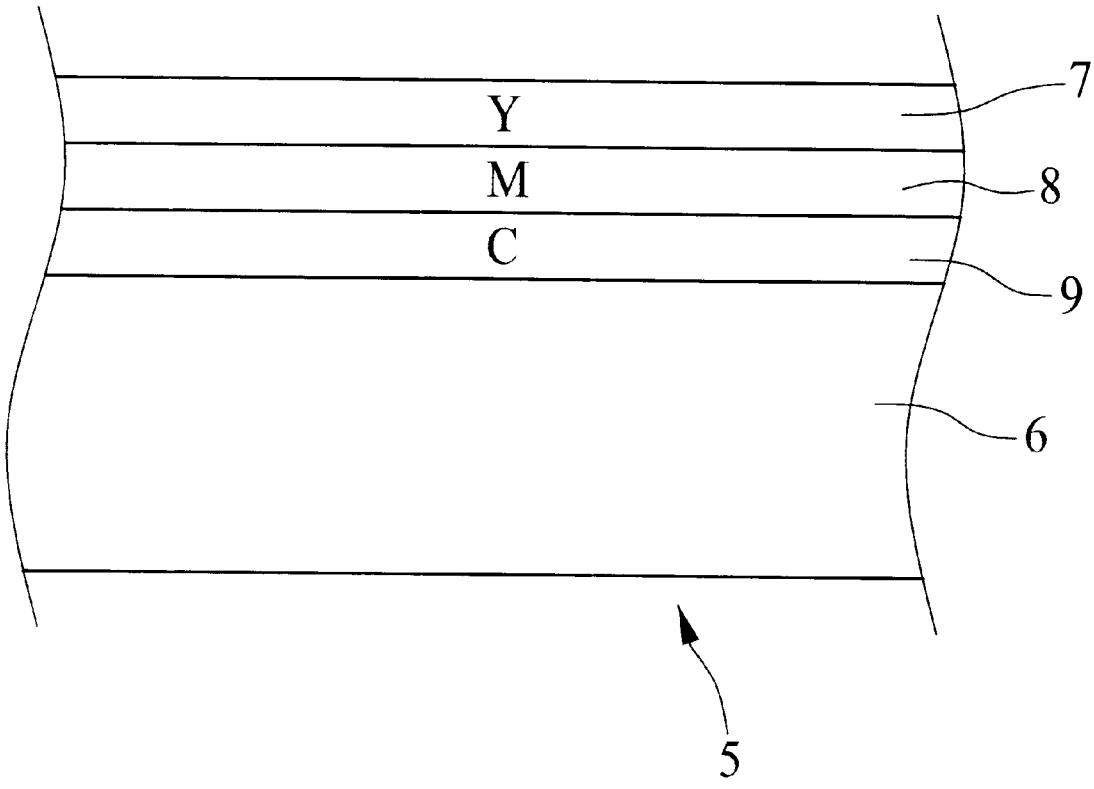
FIG.5 (PRIOR ART)
FIG. 5 is a sectional view of the recording sheet.
Figure 6A:
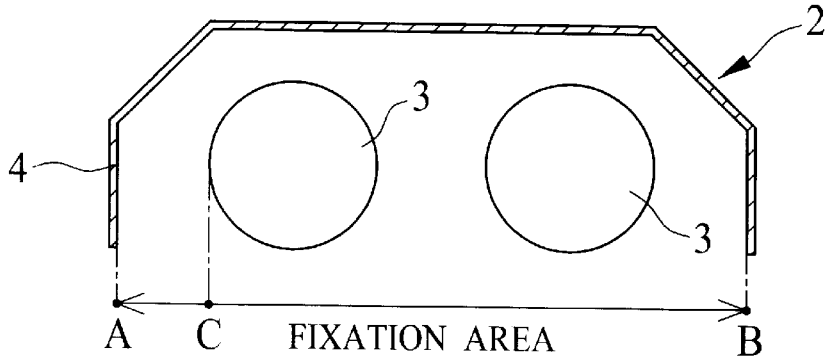
FIG.6A (PRIOR ART)
FIG. 6A is a schematic view showing an conventional fixer.
Figure 6B:
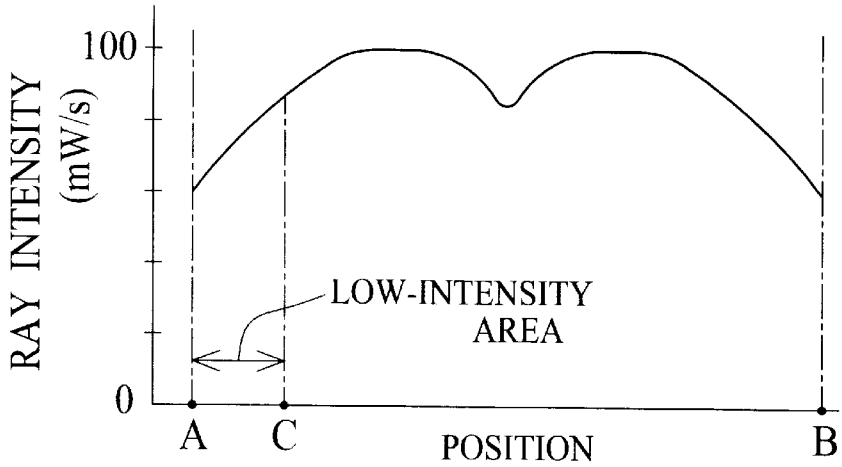
FIG.6B (PRIOR ART)
FIG. 6B is a graph showing ray intensity according to a position in fixation area of the conventional fixer.
Figure 6C:
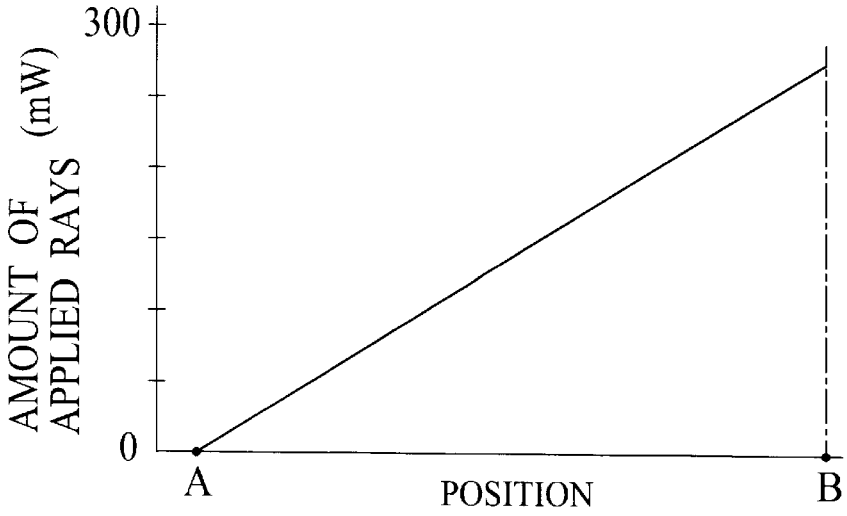
FIG.6C (PRIOR ART)
FIG. 6C is a graph showing an amount of applied ultraviolet rays in the passage fixation method.

The recording sheet 10 includes a support and a cyan coloring layer and a magenta coloring layer and a yellow coloring layer, which are formed on the support in this order. The configuration of the recording sheet 10 is the same as that shown in FIG. 5.

Among those layers, the yellow coloring layer has the highest thermal sensitivity and colors yellow in low thermal energy. The cyan coloring layer has the lowest thermal sensitivity, and is needed highest thermal energy to be colored. The yellow coloring layer has such a characteristic that its coloring ability is destroyed by application of near-ultraviolet rays of 420 nm. The magenta coloring layer, formed between the yellow and cyan coloring layers, colors magenta in a thermal energy between the necessary energy for coloring the yellow and cyan coloring layers. In addition, the magenta coloring layer has such a characteristic that its coloring ability is destroyed by application of ultraviolet rays of 365 nm. Four coloring layers may be formed in the recording sheet 10, by forming a black thermosentive coloring layer, for example.

A thermal head 16 and a platen roller 17 are disposed in a position further from the feeding roller set 12 in the advancing direction. A feeding passage is provided between the thermal head 16 and the platen roller 17. The thermal head 16 is located in a upper portion of the feeding passage, and has a heating element array 16*a* in which a large number of heating elements are arranged linearly in the direction perpendicular to the advancing direction of the recording sheet 10. The platen roller 17 is located in a lower portion of the feeding passage, and is faced to the heating element array 16*a*. The thermal head 16 is movable vertically by means of a lifting mechanism (not shown), and is biased by a spring (not shown) to the direction to press the platen roller 17.

In recording, the thermal head 16 presses the recording sheet 10 fed in the recording direction, and the heating element array 16*a* is driven to color each coloring layer. The platen roller 17 rotates subsidiary to the conveyance of the recording sheet 10, so that the heating element array 16*a* easily scrubs with the recording sheet 10.

A cutter 30 is disposed in a position further from the thermal head 16 in the advancing direction. The cutter 30 includes an upper blade being movable and a lower blade being stationary. The cutter 30 is actuated to cut the recording sheet 10 by each recording area. A magenta fixer 19 and a yellow fixer 20 are disposed in positions to face to the recording surface of the recording sheet 10.

The magenta fixer 19 includes a magenta fixation lamp 21 and a reflector 23. The yellow fixer 20 includes a yellow fixation lamp 22 and a reflector 24. The magenta fixation lamp 21 emanates ultraviolet rays peaking at a wavelength of 365 nm, to fix the magenta coloring layer of the recording sheet 10. The yellow fixation lamp 22 emanates near-ultraviolet rays peaking at a wavelength of 420 nm, to fix the yellow coloring layer of the recording sheet 10. The reflectors 23 and 24 covers the upper and lateral sides of the fixation lamps 21 and 22. The ultraviolet rays emanated from the fixation lamps 21 and 22 are reflected by the reflectors 23 and 24, and go toward the recording sheet 10. The fixation area of the fixers 19 and 20 is defined according to the sizes of the reflectors 23 and 24.

Between the yellow fixer 20 and the recording sheet 10 is provided a shutter plate for yellow 26 which is made of a material opaque to near-ultraviolet rays from the yellow fixer 20. The shutter plate for yellow 26 is usually located in a sheltering space provided between these two fixers 19 and 20. The sheltering space has a size same as the fixation area of the yellow fixer 20. The shutter plate for yellow 26 is movable between a shutting position, shown by two-dotted line in FIG. 1, to keep ultraviolet rays of the yellow fixer 20 from applying onto the recording sheet 10, and an open position, shown by solid line, to allow ultraviolet rays to apply. The movement of the shutter plate for yellow 26 is controlled by the controller 50. The controller 50 drives a shutter motor 27 through a motor driver 43. The rotation of the shutter motor 27 is transmitted to a shutter moving mechanism for yellow 28, in which the rotation is converted into horizontal movement to move the shutter plate for yellow 26.

The yellow fixation lamp 22 is turned on when the recording sheet 10 is fed in the advancing direction after thermal recording of a yellow image. Near-ultraviolet rays, peaking at a wavelength of 420 nm, is emanated from the yellow fixation lamp 22 and applied onto the yellow coloring layer of the recording sheet 10 such that the yellow recording layer is not colored even when it is heated again. When the rear end of the recording area reaches the fixation area of the yellow fixer 20, the shutter plate for yellow 26 begins to move toward the shutting position at the speed equal to that at which the recording sheet 10 is conveyed. Thereby, the shutter plate for yellow 26 covers the next-recording area, provided in the rear of the present recording area, so that the next-recording area is not fixed by the ultraviolet rays.

As described above, yellow fixation is carried out while the recording sheet 10 passes the fixation area of the yellow fixer 20, it is possible to apply the same amount of ultraviolet rays onto the entire recording area. Thus, the yellow and magenta coloring layers do not have any bad influence that may be caused by over or under fixation.

Between the magenta fixer 19 and the recording sheet 10 is provided a shutter plate for magenta 32 which is made of a material opaque to ultraviolet rays from the magenta fixer 19. The shutter plate for magenta 32 is usually located in a sheltering space provided between the magenta fixer 19 and the cutter 30. The shutter plate for magenta 32 is movable between a shutting position, shown in two-dotted line, to partially cover the fixation area of the magenta fixer 19, and an open position, shown in solid line, to retract completely from the fixation area. The shutter plate for magenta 32 is also driven by the shutter motor 27. When the controller 50 rotates the shutter motor 27 through the motor driver 43, the rotation of the shutter motor 27 is transmitted to a shutter moving mechanism for magenta 33, in which the rotation is converted into horizontal movement to move the shutter plate for magenta 32.

The magenta fixation lamp 21 is turned on when the recording sheet 10 is fed in the advancing direction after thermal recording of a magenta image. Ultraviolet rays, peaking at a wavelength of 365 n.m, is emanated from the magenta fixation lamp 21 and applied onto the magenta coloring layer such that the magenta recording layer is not colored even when it is heated again.

Figure 2A:
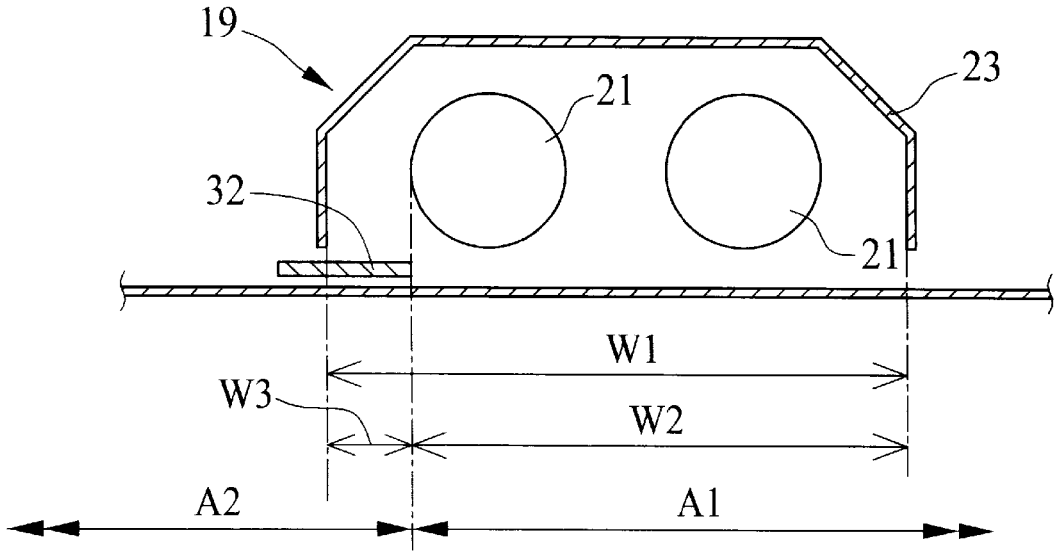
FIGS. 2A and 2B,are explanatory views showing a fixation area and a shutter plate for magenta recording.
Figure 2B:
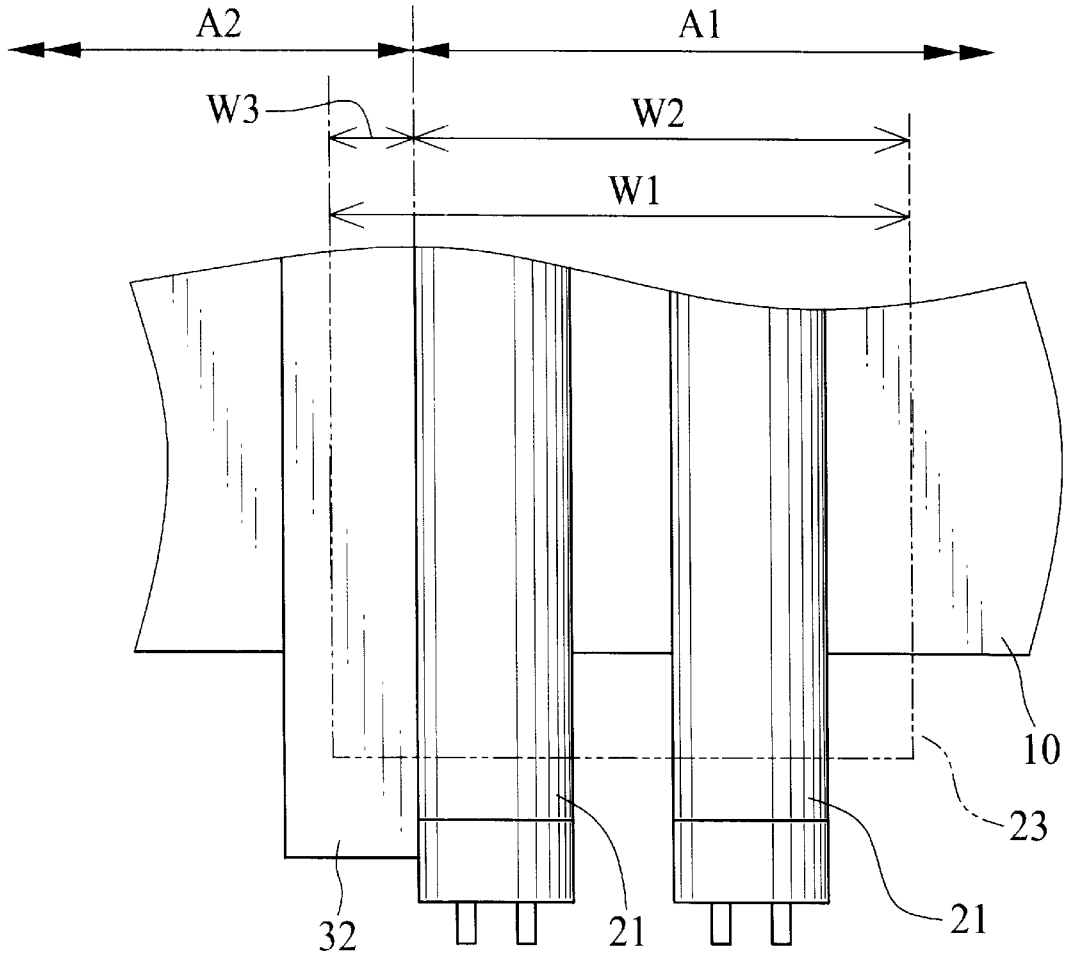

As shown in FIGS. 2A and 2B, when the rear end of the recording area A1 reaches the fixation area of the magenta fixer 19 (first fixation, area W1), the shutter plate for magenta 32 begins to move toward the shutting position at the speed equal to that at which the recording sheet 10 is conveyed. Thereby, the shutter plate for yellow 26 covers the next-recording area A2, provided in the rear of the recording area A1, so that the next-recording area A2 is not fixed by the ultraviolet rays.

When the shutter plate for magenta 32 reaches the shutting position, the controller 50 controls the feeding roller set 12 to stop feeding the recording sheet 10. At that time, the magenta fixer 19 has a second fixation area W2, which is smaller by the low-intensity area W3 than the first fixation area W1. The rear end of the recording area A1 is located at the position in which high-intensity ultraviolet rays are applied.

Then, ultraviolet rays from the magenta fixer lamp 21 are applied to the rear portion of the recording area A1, until the amount of applied rays becomes the same as that in the front portion of the recording area. Ultraviolet rays of high-intensity are applied to the rear end of the recording area A1, in which the amount of applied rays is the lowest, so fixation time can be shortened.

An ejection roller set 36 and an ejection slit 37 are disposed in positions further from the yellow fixer 20 in the advancing direction. The ejection roller set 36 includes a capstan roller 38 and a pinch roller 39. The capstan roller 38 is rotated by the feeding motor 13. The pinch roller 39 rotates subsidiary to the rotation of the capstan roller 38. After the recording is completed, the recording sheet 10 is nipped by the ejection roller set 36 and ejected outside of the printer through the ejection slit 37.

Figure 3:
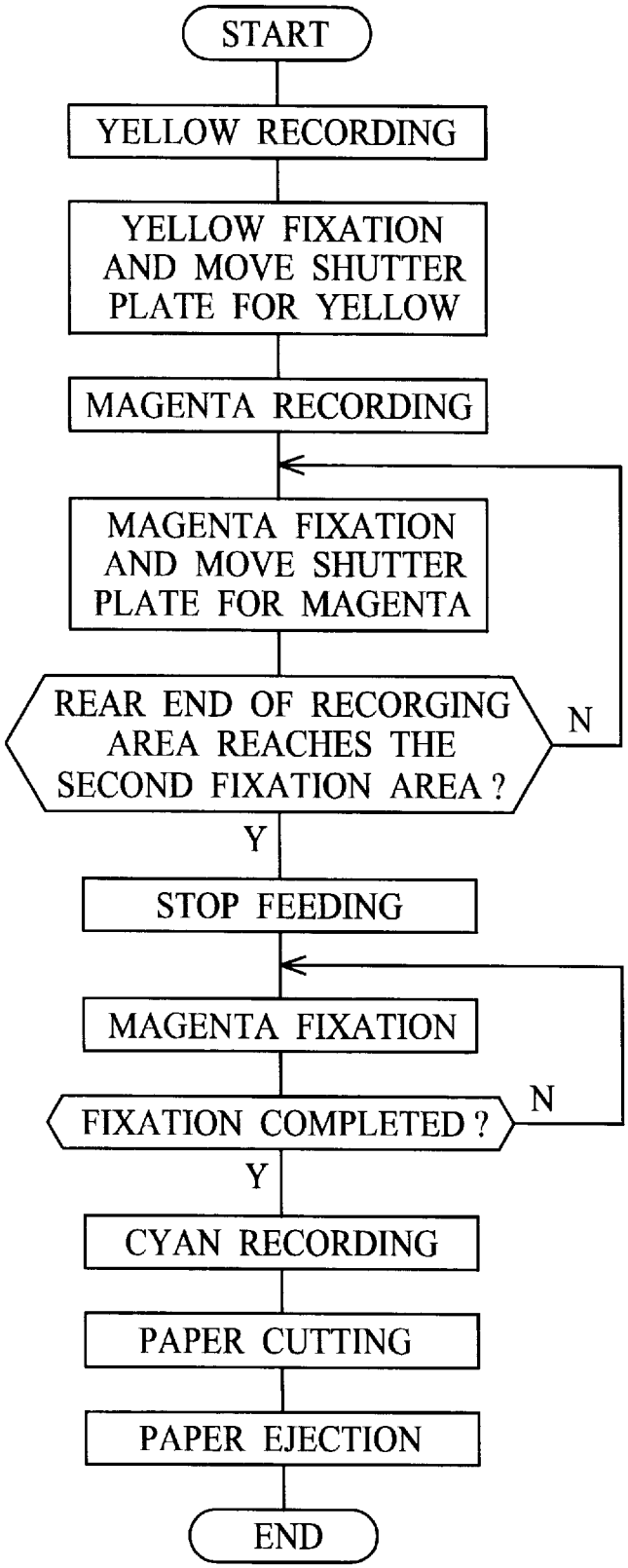
FIG. 3 is a flow chart showing a printing operation.

Next, referring to flow chart shown in FIG. 3, the operation of the printer having the above described configurations will be described. On starting the printing operation, the controller 50 drives the feeding motor 13 through the motor driver 41. The feeding roller set 12 rotates to pull the recording sheet 10 from the recording sheet roll 11, and feeds it in the advancing direction. When the recording sheet 10 is fed by the length of one print sheet, the controller 50 controls the feeding motor 13 to stop feeding the recording sheet 10.

Then, the thermal head 16 moves down to press the platen roller 17, so that the recording sheet 10 is put between the thermal head 16 and the platen roller 17. Afterwards, the feeding roller set 12 feeds the recording sheet 10 in the recording direction. When the rear end of the recording area reaches the heating element array 16*a*, the thermal head 16 drives the heating element array 16*a* according to tonal values of a yellow image, so that the yellow image is recorded in the yellow coloring layer.

When thermal recording of the yellow image is completed, the feeding roller set 12 stops feeding the recording sheet 10 in the recording direction, and the thermal head 16 moves upward to release the recording sheet 10. The feeding roller set 12 feeds the recording sheet 10 in the advancing direction again. When the front end of the recording area reaches the fixation area of the yellow fixer 20, the yellow fixer lamp 22 is turned on, so that near-ultraviolet rays are emanated toward the recording sheet 10. Then, the yellow coloring layer of the recording sheet 10 is fixed by passage fixation method.

When the rear end of the recording area reaches the fixation area of the yellow fixer 20, the shutter moving mechanism for yellow 28 moves the shutter plate for yellow 26 toward the shutting position at the same speed of the recording sheet 10. Therefore, whole recording area passes the fixation area of the yellow fixer 20 without applying ultraviolet rays onto the next-recording area, which causes the yellow coloring layer in the whole recording area to be fixed properly.

After the yellow fixation, the feeding motor 13 drives the feeding roller set 12 to rotate backwards, to feed the recording sheet 10 in the recording direction. When the rear end of the recording area reaches the thermal head 16, the feeding roller set 12 is stopped, and the thermal head 16 moves down such that the recording sheet 10 is nipped between the thermal head 16 and the platen roller 17, in the same way as yellow recording. Then, the feeding roller set 12 rotates backward to feed the recording sheet 10 in the recording direction. The thermal head 16 drives the heating element array 16*a* according to tonal value of each pixel in a magenta image, to record the magenta image to the magenta coloring layer After magenta recording, the feeding roller set 12 stops its rotation, and the thermal head 16 moves upward to release the recording sheet 10. Then, the feeding roller set 12 rotates forward to feed the recording sheet 10 in the advancing direction. At the same time, the magenta fixer 19 drives the magenta fixer lamp 21 to emanate ultraviolet rays onto the recording sheet 10, so that the magenta coloring layer is fixed while feeding the recording sheet 10.

When the rear end of the recording area reaches the first fixation area W1 of the magenta fixer 19, the shutter motor 27 is actuated to move toward the shutting position at the same speed of the recording sheet 10. Thus, the next-recording area A2 in FIGS. 2A and 2B, is kept from being fixed by ultraviolet rays. When the shutter plate for magenta 32 reaches the shutting position, the feeding roller set 12 stops feeding the recording sheet 10. Afterwards, the magenta fixer lamp 19 is driven to apply ultraviolet rays to the rear portion of the recording area A1. Since the low-intensity area W3 is hidden by the shutter plate for magenta 32, that is not so large as the shutter plate for yellow 26, it is possible to shorten the fixation time without enlarging the printer size.

After fixation of the magenta coloring layer, the feeding roller set 12 rotates to feed the recording sheet 10 in the recording direction. As the rear end of the recording area reaches the thermal head 16, the thermal head 16 moves downward so that the recording sheet 10 is nipped between the thermal head 16 and the platen roller 17.

Then, the recording sheet 10 is fed in the recording direction by the feeding roller set 12. The heating element array 16*a* is driven to record a cyan image to the cyan coloring layer of the recording sheet 10. After cyan recording, the feeding roller set 12 rotates forward to feed the recording sheet 10 in the advancing direction. Also the ejection roller set 36 rotates to feed the recording sheet 10, the front portion of which is emerges outside of the printer through the ejection slit 37. Then, the cutter 30 is driven to cut the recording sheet 10 to make a print.

In magenta fixation, an adequate fixation to the rear end of the recording area causes over-fixation to the area near the rear end. Though the cyan coloring layer is not influenced by the over-fixation, it is possible to make a uniform fixation to the rear portion of the recording area by providing the shutter plate for yellow 26 movable to the magenta fixation area. In applying ultraviolet rays to the stationary recording sheet 10, the shutter plate for yellow 26 moves in the recording direction from the open position such that the magenta fixation area is shielded gradually from its front side, in which ultraviolet rays are applied more than the rear side. Thereby, it is possible to make an integral amount of the applied ultraviolet rays uniform over the whole recording area.

Figure 4A:
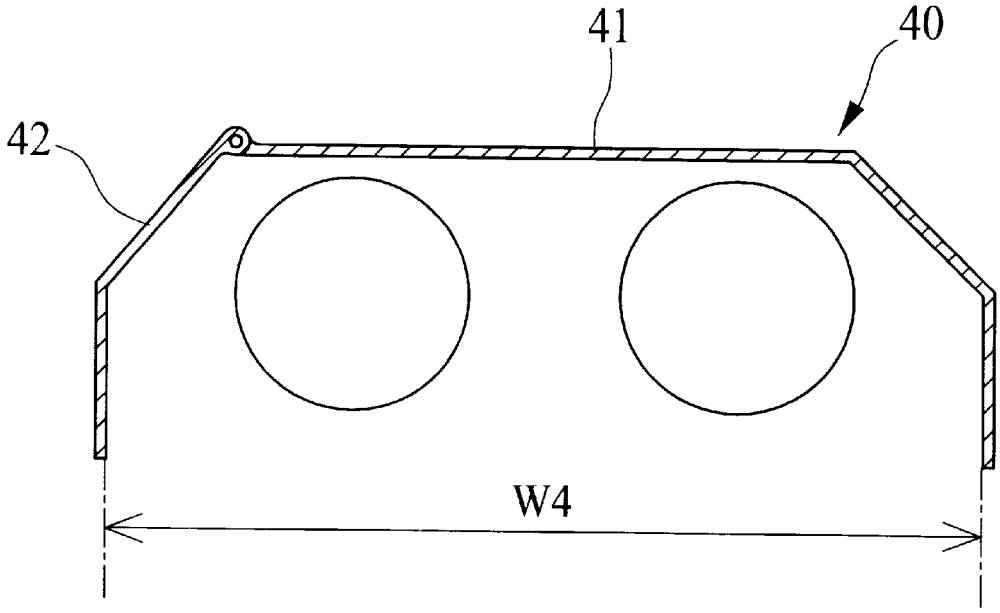
FIG. 4A is a schematic view showing a magenta fixer assembly in the second embodiment.
Figure 4B:
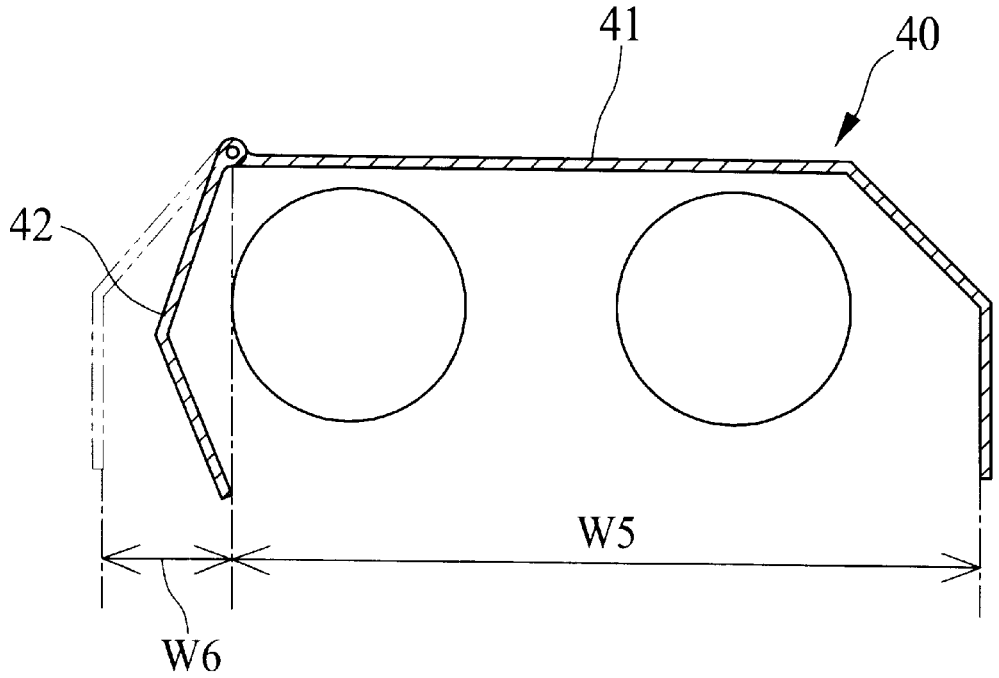
FIG. 4B is a schematic view showing an another state of the magenta fixer assembly in the second embodiment.

Although the shutter plates are separated from the fixers, it is possible to substitute a movable side wall of the reflector for the shutter plate. As shown in FIG. 4A, a shutter plate 42 is rotatably attached to a reflector 41 such that the shutter plate 42 comprises the left side wall of the reflector 41. The shutter plate 42 is usually located at an open position where the fixer 40 has a first fixation area W4. In fixation, the shutter plate 42 moves to a shutting position where the shutter plate 42 covers the low-intensity area W6, and the fixer 40 has a second fixation area W5. Thereby, the shutter plate 42 can be provided with slight increase of parts and space. A moving mechanism with cams and gears may be provided to rotate the shutter plate 42. A solenoid for pulling the shutter plate 42 is also applicable.

In the above mentioned embodiments, long recording sheet 10 is cut after printing operation to have a color print, but the present invention is applicable to a color thermal printer with a plurality of non-continuous recording sheets. In addition, the present invention is also applicable to a color thermal printer to record an image by putting a recording sheet around a large platen drum.

The present invention is not to be limited to the above embodiments, but on the contrary, various modifications are possible to those skilled in the art without departing from the scope of claims appended hereto.

What is claimed is:

1. A thermal printer for recording an image onto a recording area of a continuous thermosensitive recording material that is drawn from a roll, said recording material including at least one thermosensitive coloring layer that is colored by heat and fixed by electromagnetic rays of peculiar wavelength range, and said recording area is formed in a leader portion of said recording material, said thermal printer comprising:

feeding means for feeding said recording material alternatively in a first direction and a second direction along a feeding pass, said first direction being a direction to draw said recording material from said roll, said second direction being opposite to said first direction;

a thermal head for recording said image to said coloring layer of said recording area in feeding said recording material in said second direction;

a fixer for applying said electromagnetic rays onto a first fixation area to fix said coloring layer that is fed in said first direction after thermal recording, a rear end portion of said first fixation area being a low-intensity area whose intensity of said electromagnetic rays is relatively low;

a shutter plate for covering said low-intensity area to change an area to apply said electromagnetic rays into a second fixation area from said first fixation area;

a shutter moving mechanism for moving said shutter plate between a first position where said electromagnetic rays are applied to said first fixation area, and a second position where said electromagnetic rays are applied to said second fixation area; and a controller for moving said shutter plate from said first position to said second position at a speed equal to conveyance of said recording material when a rear end of said recording area reaches a rear end of said first fixation area, stopping conveyance of said recording material when said rear end of said recording area reaches a rear end of said second fixation area, and stopping application of said electromagnetic rays onto a rear portion of said recording area when an amount of applied rays in said rear end of said recording area becomes is equal to that of a front portion of said recording area.

2. A thermal printer as claimed in claim 1, wherein said feeding means includes a pair of feeding rollers, said feeding rollers being located in positions upstream of said thermal head in said first direction.

3. A thermal printer as claimed in claim 2, wherein said fixer is located in a position downstream of said thermal head in said first direction.

4. A thermal printer as claimed in claim 3, wherein said fixer includes a fixation lamp for emanating said electromagnetic rays and a reflector for reflecting said electromagnetic rays toward said recording material.

5. A thermal printer as claimed in claim 4, wherein said reflector includes a reflector body and a side wall that is rotatably attached to a rear side of said reflector body, said side wall being substituted for said shutter plate.

6. A thermal printer for recording an image onto a recording area of a continuous thermosensitive recording material that is drawn from a roll, said recording material including first, second and third thermosensitive coloring layers, said first to third coloring layers being different in colors to be developed and thermal sensitivities, said first coloring layer having fixability to electromagnetic rays of a first wavelength range, said second coloring layer having fixability to electromagnetic rays of a second wavelength range, and said recording area being formed in a leading portion of said recording material, said coloring thermal printer comprising:

feeding means for feeding said recording material alternatively in a first direction and a second direction along a feeding pass, said first direction being a direction to draw said recording material from said roll, said second direction being opposite to said first direction;

a thermal head for recording first, second and third images respectively to said first to third coloring layers in said recording area in feeding said recording material in said second direction;

a first fixer for applying electromagnetic rays of said first wavelength range onto a first fixation area to fix said first coloring layer that is fed in said first direction after thermal recording;

a first shutter plate for covering said first fixation area to shield electromagnetic rays of said first wavelength range;

a second fixer, for applying electromagnetic rays of said second wavelength range onto a second fixation area to fix said second coloring layer that is fed in said first direction after thermal recording, a rear portion of said second fixation area being a low-intensity area whose intensity of said electromagnetic rays is relatively low;

a second shutter plate for covering said low-intensity area to change an area to apply electromagnetic wave of said second wavelength range into a third fixation area from said second fixation area;

a shutter moving mechanism for moving said second shutter plate between a first position where electromagnetic rays of said second wavelength range are applied to said second fixation area, and a second position where electromagnetic rays of said second wavelength range are applied to said third fixation area; and a controller for moving said second shutter plate from said first position to said second position at a speed equal to conveyance of said recording material when a rear end of said recording area reaches a rear end of said second fixation area, stopping conveyance of said recording material when said rear end of said recording area reaches a rear end of said third fixation area, and stopping application of electromagnetic rays of said second wavelength range onto a rear portion of said recording area when an amount of applied rays in said rear end of said recording area is equal to that of a front portion of said recording area.

7. A thermal printer as claimed in claim 6, wherein said first shutter plate is movable between an open position to retract from said first fixation area and a closed position to cover said first fixation area completely, and said shutter moving mechanism moves said first shutter plate toward said closed position from said open position at a speed equal to conveyance of said recording material when a rear end of said recording area reaches a rear end of said first fixation area.

8. A thermal printer as claimed in claim 7, wherein yellow, magenta and cyan images are recorded respectively to said first, second and third coloring layers.

9. A thermal printer as claimed in claim 8, wherein said first fixer includes a first fixation lamp for emanating electromagnetic rays of first wavelength range and a first reflector for reflecting electromagnetic rays of said first wavelength range toward said recording material, and said second fixer includes a second fixation lamp for emanating electromagnetic rays of second wavelength range and a second reflector for reflecting electromagnetic rays of said second wavelength range toward said recording material.

10. A thermal printer as claimed in claim 9, wherein aid second reflector includes a reflector body and a side wall that is rotatably attached to a rear side of said reflector body, said side wall being substituted for said second shutter plate.

11. A thermal recording method for recording an image onto a recording area of a continuous thermosensitive recording material that is drawn from a roll, said recording material including at least one thermosensitive coloring layer that is colored by heat and fixed by electromagnetic rays of peculiar wavelength range, said recording area is formed in a leader portion of said recording material, said thermal recording method comprising steps of:

A. drawing said recording material from said roll and feeding said recording material in said first direction;

B. feeding said recording material in a second direction that is opposite to said first direction;

C. recording said image to said coloring layer of said recording area in feeding said recording material in said first direction;

D. feeding said recording material in said second direction;

E. applying said electromagnetic rays to said recording material for fixing said coloring layer of said recording area while said recording area passes said fixation area in said first direction;

F. moving a shutter plate at a speed equal to conveyance of said recording material for preventing a rear portion of said recording area from being applied to said electromagnetic rays when a rear end of said recording area reaches a rear end of said fixation area; and G. stopping conveyance of said recording material while said rear end is located in said fixation area, and applying said electromagnetic rays to a rear portion until an amount of applied rays is equal to that of a front portion of said recording area.

12. A thermal recording method as claimed in claim 11, wherein said electromagnetic rays are emanated from a fixer, said fixer including a fixation lamp to emanate said electromagnetic rays and a reflector for reflecting said electromagnetic rays toward said recording material.

13. A thermal recording method as claimed in claim 12, wherein said reflector includes a reflector body and a side wall that is rotatably attached to a rear side of said reflector body, said side wall being substituted for said shutter plate.

14. A thermal recording method as claimed in claim 11, wherein said at least one coloring layer has cyan, magenta and yellow recording layers formed on a support in this order, said steps A to F being carried out in recording to said yellow coloring layer, and electromagnetic rays of first wavelength range being used in said steps E and F, said steps B to G being carried out in recording to said magenta coloring layer, and electromagnetic rays of second wavelength range being used in said steps E to G, and said steps B and C being carried out in recording to said cyan coloring layer.

* * * * *